US006801137B2

(12) United States Patent
Eggers

(10) Patent No.: US 6,801,137 B2
(45) Date of Patent: Oct. 5, 2004

(54) BIDIRECTIONAL COMMUNICATION BETWEEN A SENSOR UNIT AND A MONITOR UNIT IN PATIENT MONITORING

(75) Inventor: Philip N. Eggers, Poway, CA (US)

(73) Assignee: Cardionet, Inc., San Diego, CA (US)

( * ) Notice: Subject to any disclaimer, the term of this patent is extended or adjusted under 35 U.S.C. 154(b) by 207 days.

(21) Appl. No.: 09/841,134

(22) Filed: Apr. 23, 2001

(65) Prior Publication Data

US 2002/0186821 A1 Dec. 12, 2002

(51) Int. Cl.[7] ..... G08B 25/00

(52) U.S. Cl. ..... 340/870.09; 379/38; 455/67.1

(58) Field of Search ..... 340/870.09, 539, 340/825.36, 825.39, 7.33, 7.36, 573.4; 128/903; 455/1, 63, 67.1, 67.3, 68; 392/357.07, 357.09; 379/38

(56) References Cited

U.S. PATENT DOCUMENTS

| | | | | |
|---|---|---|---|---|
| 3,478,344 A | | 11/1969 | Schwitzgebel et al. | 340/312 |
| 3,768,014 A | | 10/1973 | Smith et al. | 324/158 R |
| 3,885,552 A | | 5/1975 | Kennedy | 128/2.05 R |
| 3,902,478 A | | 9/1975 | Konopasek et al. | 128/2.06 F |
| 3,925,762 A | | 12/1975 | Keitlinger et al. | 340/150 |
| 4,173,971 A | | 11/1979 | Karz | 128/702 |
| 4,183,354 A | | 1/1980 | Sibley et al. | 128/711 |
| 4,211,237 A | | 7/1980 | Nagel | 128/698 |
| 4,230,127 A | | 10/1980 | Larson | 128/706 |
| 4,241,237 A | | 12/1980 | Paraskevakos et al. | 179/2 AM |
| 4,457,315 A | | 7/1984 | Bennish | 128/704 |
| 4,531,527 A | | 7/1985 | Reinhold, Jr. et al. | 128/696 |
| 4,535,783 A | | 8/1985 | Marangoni | 128/711 |
| 4,598,272 A | * | 7/1986 | Cox | 340/539 |
| 4,651,157 A | | 3/1987 | Gray et al. | 342/457 |
| 4,675,656 A | * | 6/1987 | Narcisse | 340/539 |
| 4,706,689 A | | 11/1987 | Man | 128/903 |
| 4,742,357 A | | 5/1988 | Rackley | 342/457 |
| 4,750,197 A | | 6/1988 | Denekamp et al. | 379/58 |
| 4,777,478 A | * | 10/1988 | Hirsch et al. | 340/573.3 |
| 4,785,291 A | * | 11/1988 | Hawthorne | 340/573.4 |
| 4,819,860 A | | 4/1989 | Hargrove et al. | 228/668 |
| 4,952,928 A | | 8/1990 | Carroll et al. | 340/825.54 |
| 5,003,984 A | | 4/1991 | Muraki et al. | 128/710 |
| 5,113,869 A | | 5/1992 | Nappholz et al. | 128/696 |
| 5,172,698 A | | 12/1992 | Stanko | 128/697 |
| 5,223,844 A | | 6/1993 | Mansell et al. | 342/357 |
| 5,301,105 A | | 4/1994 | Cummings, Jr. | 364/401 |
| 5,309,920 A | | 5/1994 | Gallant et al. | 128/710 |
| 5,311,197 A | | 5/1994 | Sorden et al. | 342/457 |

(List continued on next page.)

FOREIGN PATENT DOCUMENTS

| | | |
|---|---|---|
| DE | 4414 907 | 6/1995 |
| EP | 0 484 880 | 5/1992 |
| EP | 0 811 959 | 12/1997 |
| EP | 0 834 846 | 4/1998 |
| EP | 1 072 994 | 1/2001 |
| FR | 2 787 905 | 6/2000 |
| WO | WO 94/13197 | 6/1994 |
| WO | WO 96/25877 | 8/1996 |
| WO | WO 97/00708 | 1/1997 |
| WO | WO 99/44494 | 9/1999 |
| WO | WO 00/30529 | 6/2000 |
| WO | WO 00/62663 | 10/2000 |

*Primary Examiner*—Michael Horabik
*Assistant Examiner*—Hung Q Dang
(74) *Attorney, Agent, or Firm*—Fish & Richardson P.C.

(57) ABSTRACT

A monitoring system includes a remote monitoring unit with a sensor unit in bidirectional wireless communication with a monitor unit. Information is transmitted bidirectionally between the sensor unit and the monitor unit. The monitor unit may inform the sensor unit that transmitted data has been corrupted, that the distance between the units is becoming too large, that transmission signal strength may be altered, that interference requires a change in transmitting frequency, or that attention is needed by the patient to the monitor unit.

11 Claims, 3 Drawing Sheets

U.S. PATENT DOCUMENTS 5,318,592 A 6/1994 Schaldach ..... 607/5
5,321,618 A 6/1994 Gessman ..... 364/413.06
5,334,974 A 8/1994 Simms et al. ..... 340/990
5,335,664 A 8/1994 Nagashima ..... 128/696
5,336,245 A 8/1994 Adams et al. ..... 607/32
5,348,008 A 9/1994 Bornn et al. ..... 128/642
5,389,934 A 2/1995 Kass ..... 342/357
5,394,879 A * 3/1995 Gorman ..... 600/520
5,418,537 A 5/1995 Bird ..... 342/356
5,422,816 A 6/1995 Sprague et al. ..... 364/449
5,423,869 A 6/1995 Poore ..... 607/18
5,458,123 A 10/1995 Unger ..... 128/696
5,461,365 A * 10/1995 Schlager et al. ..... 340/573.4
5,470,233 A 11/1995 Fruchterman et al. ..... 434/112
5,479,482 A 12/1995 Grimes ..... 379/59
5,487,755 A 1/1996 Snell et al. ..... 607/27
5,497,149 A 3/1996 Fast ..... 340/988
5,503,158 A 4/1996 Coppock et al. ..... 128/696
5,504,491 A 4/1996 Chapman ..... 342/357
5,515,419 A 5/1996 Sheffer ..... 379/58
5,522,396 A 6/1996 Langer et al. ..... 128/696
5,544,661 A 8/1996 Davis et al. ..... 128/700
5,549,113 A 8/1996 Halleck et al. ..... 128/671
5,564,429 A 10/1996 Bornn et al. ..... 128/696
5,568,814 A 10/1996 Gallant et al. ..... 128/672
5,573,506 A 11/1996 Vasko ..... 604/65
5,576,952 A 11/1996 Stutman et al. ..... 364/413.02
5,579,775 A * 12/1996 Dempsey et al. ..... 600/483
5,617,871 A 4/1997 Burrows ..... 128/696
5,620,472 A 4/1997 Rahbari ..... 607/27
5,626,624 A 5/1997 Schaldach et al. ..... 607/24
5,626,630 A 5/1997 Markowitz et al. ..... 607/60
5,629,678 A 5/1997 Gargano et al. ..... 340/573
5,649,303 A * 7/1997 Hess et al. ..... 455/63
5,652,570 A 7/1997 Lepkofker ..... 340/573
5,678,562 A 10/1997 Sellers ..... 128/710
5,704,351 A 1/1998 Mortara et al. ..... 128/630
5,704,364 A 1/1998 Saltzstein et al. ..... 128/696
5,704,366 A 1/1998 Tacklind et al. ..... 128/716
5,713,856 A * 2/1998 Eggers et al. ..... 604/65
5,720,770 A 2/1998 Nappholz et al. ..... 607/30
5,720,771 A 2/1998 Snell ..... 607/60
5,724,025 A 3/1998 Tavori ..... 340/573
5,729,197 A 3/1998 Cash ..... 340/539
5,730,143 A 3/1998 Schwarzberg ..... 128/710
5,731,757 A 3/1998 Layson, Jr. ..... 340/573
5,748,103 A 5/1998 Flach et al. ..... 340/870.07
5,749,367 A 5/1998 Gamlyn et al. ..... 128/696
5,749,907 A 5/1998 Mann ..... 607/27
5,752,976 A 5/1998 Duffin et al. ..... 607/32
5,759,199 A 6/1998 Snell et al. ..... 607/60
5,882,300 A 3/1999 Malinouskas et al. ..... 600/300
5,891,169 A 4/1999 Boheim et al. ..... 607/4
5,913,827 A 6/1999 Gorman ..... 600/509
5,913,881 A 6/1999 Benz et al. ..... 607/36
5,931,791 A 8/1999 Saltzstein et al. ..... 600/513
5,941,829 A 8/1999 Saltzstein et al. ..... 600/509
5,944,659 A 8/1999 Flach et al. ..... 600/300
5,950,110 A * 9/1999 Hendrickson ..... 45/1
5,959,529 A * 9/1999 Kail, IV ..... 340/539
5,964,794 A 10/1999 Bolz et al. ..... 607/121
5,966,692 A 10/1999 Langer et al. ..... 705/3
5,970,986 A 10/1999 Bolz et al. ..... 128/899
5,987,352 A 11/1999 Klein et al. ..... 600/509
5,987,519 A 11/1999 Peifer et al. ..... 709/230
6,026,008 A 2/2000 Feese ..... 365/63
6,038,469 A 3/2000 Karlsson et al. ..... 600/512
6,073,046 A 6/2000 Patel et al. ..... 600/509
6,083,248 A 7/2000 Thompson ..... 607/30
6,088,608 A 7/2000 Schulman et al. ..... 600/345
6,093,146 A 7/2000 Filangeri ..... 600/300
6,101,478 A 8/2000 Brown ..... 705/2
6,102,856 A 8/2000 Groff et al. ..... 600/301
6,154,674 A 11/2000 Meier ..... 607/23
6,160,478 A 12/2000 Jacobsen ..... 340/539
6,181,966 B1 1/2001 Nigram ..... 607/4
6,192,274 B1 2/2001 Worzewski ..... 607/14
6,225,901 B1 5/2001 Kail, IV ..... 340/539
6,245,092 B1 6/2001 Schaldach ..... 607/1
6,263,243 B1 7/2001 Lang ..... 607/17
6,466,793 B1 * 10/2002 Wallstedt et al. ..... 455/450
2002/0143576 A1 10/2002 Nolvak et al.

* cited by examiner

BIDIRECTIONAL COMMUNICATION BETWEEN A SENSOR UNIT AND A MONITOR UNIT IN PATIENT MONITORING

This invention relates to patient monitoring systems, and, more particularly, to the use of bidirectional communication between a sensor unit and a monitor unit.

BACKGROUND OF THE INVENTION

Advances in sensor technology, electronics, and communications have made it possible for physiological characteristics of patients to be monitored even when the patients are ambulatory and not in continuous, direct contact with a hospital monitoring system. For example, U.S. Pat. No. 5,959,529 describes a monitoring system having a remote monitoring unit in which a monitor unit receives the sensor output of a sensor unit that is associated with the patient. The sensor unit and the monitor unit are preferably linked by a wireless communication path. The remote monitoring unit monitors one or more physiological characteristics of the patient according to the medical problem of the patient, such as the heartbeat and its waveform. Under selected conditions, the remote monitoring unit communicates with a central unit to provide data to the central unit and to receive programming, instructions, and medical instructions from the central unit.

The monitoring system of the '529 patent and other monitoring systems, while operable, offer the opportunity for improvement and optimization of the performance of the systems. The present invention provides such an improvement and optimization for remote patient monitoring systems.

SUMMARY OF THE INVENTION

The present invention provides a monitoring system and a method for its use. The monitoring system retains the basic architecture of a remote monitoring unit having a sensor unit and a monitor unit, which in turn may communicate with a central unit. The performance of the system achieves improved communications performance between the sensor unit and the monitor unit.

In accordance with the invention, a monitoring system comprises a remote monitoring unit having a sensor unit, which in turn comprises a sensor having a sensor output, a sensor bidirectional local transceiver that receives the sensor output, and a sensor unit processor in communication with the sensor unit bidirectional local transceiver. The remote monitoring unit further comprises a monitor unit having a monitor unit bidirectional local transceiver that supports bidirectional wireless communications with the sensor bidirectional local transceiver, a monitor unit processor in communication with the monitor unit bidirectional local transceiver, and a monitor unit bidirectional remote transceiver in communication with the monitor unit processor. The monitoring system may further include a central unit comprising a central unit bidirectional remote transceiver supporting bidirectional communications with the monitor unit bidirectional remote transceiver, and a central unit processor in communication with the central unit bidirectional remote transceiver.

A key feature of the monitoring system is that it transmits information bidirectionally between the sensor unit and the monitor unit. The sensor unit is conventionally viewed as having only a transmitter to transmit information to the monitor unit. However, substantial improvements in system performance as well as user convenience result from bidirectional communication between the sensor unit and the monitor unit.

For example, it is possible that information transmitted from the sensor unit to the monitor unit is corrupted in some fashion. Corruption detection techniques may be employed by the monitor unit. The monitor unit transmits a retransmit signal to the sensor unit in the event that the information is corrupted, and the sensor unit may retransmit the information to the monitor unit until uncorrupted information is received at the monitor unit.

In another case, the monitor unit determines a signal strength of the information transmitted from the sensor unit to the monitor unit. The monitor unit may then transmit a distance warning signal to the sensor unit that the patient is straying too far from the monitor unit. The monitor unit may also send a signal-strength signal to the sensor unit so that the power output of the sensor unit may be adjusted as required under the circumstances so that no more battery power is consumed than is necessary.

In yet another situation, the sensor unit may transmit information to the monitor unit at a first frequency, and the monitor unit determines whether the signal is adversely affected by frequency-dependent interference. The monitor unit transmits a frequency-change signal to the sensor unit in the event that the information is adversely affected by frequency-dependent interference, so that the sensor unit may transmit further information to the monitor unit at a second frequency.

The monitor unit may also transmit a warning signal to the sensor unit to signal the patient to take action such as replacing a battery, viewing a message, visiting the monitor unit, and so on.

Thus, in the present approach the sensor unit is not viewed simply as a transmit-only device, which senses a physiological or other condition, converts the sensed value to an electrical signal, and then transmits the electrical signal to the monitor unit. Instead, the quality of the information received at the monitor unit and the performance of the local transceiver system may be controlled with communications back to the sensor system, and other information may be communicated to the patient through the sensor unit.

Other features and advantages of the present invention will be apparent from the following more detailed description of the preferred embodiment, taken in conjunction with the accompanying drawings, which illustrate, by way of example, the principles of the invention. The scope of the invention is not, however, limited to this preferred embodiment.

DETAILED DESCRIPTION OF THE INVENTION

Figure 1:
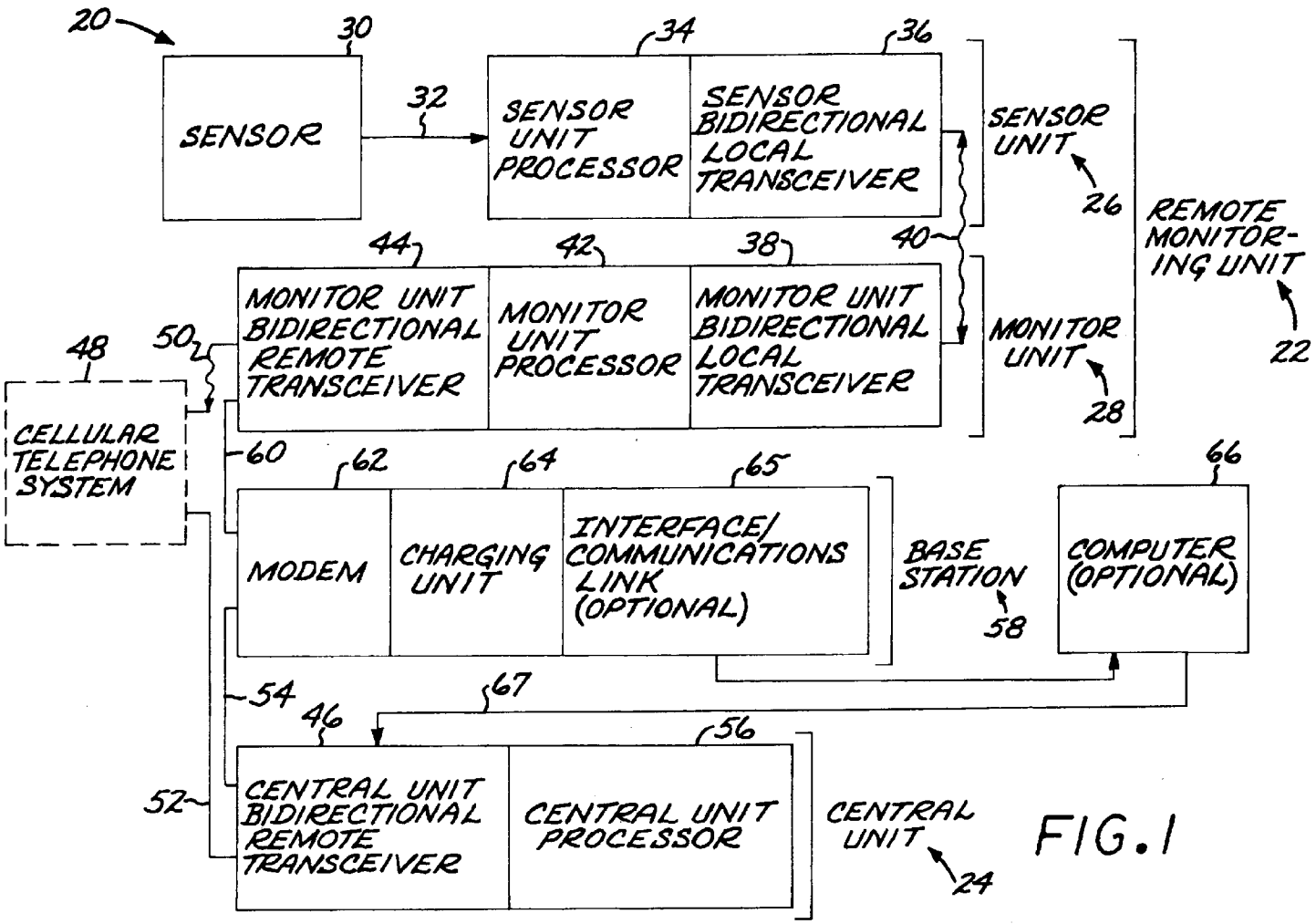
FIG. 1 is a block diagram of a monitoring system.

FIG. 1 is a block diagram of a monitoring system 20. The monitoring system 20 comprises a remote monitoring unit 22 and a central unit 24. The remote monitoring unit 22 includes a sensor unit 26 and a monitor unit 28. The sensor unit 26 is normally carried on the body of a patient and monitors some condition of the patient or associated with the patient. The monitor unit 28 is located in moderate proximity to the patient. For example, the monitor unit 28 may be carried on the body of the patient, such as on a belt clip in the manner of a pager, or it may be placed in one room of the patient's home while the patient moves about the home. The sensor unit 26 and the monitor unit 28 are in continuous wireless communication with each other. The central unit 24 typically includes a dedicated computer, a file server, or a network connection. The central unit 24 usually serves multiple remote monitoring units 22 assigned to different patients and is in selective periodic communication with each of the remote monitoring units 22 by a wireless or land-line communication link, or through the internet.

The sensor unit 26 includes a sensor 30, and in some cases multiple sensors 30. The sensor 30 performs only a sensing function and not a control function for some other piece of apparatus. Examples of operable sensors 30 include a heart monitor sensor, a blood pressure monitor sensor, a temperature monitor sensor, a respiration sensor, a brain wave sensor, a blood chemistry sensor such as a blood glucose sensor or a blood oxygen sensor, a patient position sensor, and a patient activity sensor. Sensors of various types are known in the art, and the details of their construction and operation do not form a part of the present invention.

A sensor output 32 of each sensor 30 is provided to a sensor unit processor 34, which typically includes a microprocessor and may include necessary electronics associated with the sensor 30 such as a signal conditioner, an analog-to-digital converter, and the like. The sensor unit processor 34 may also include a patient warning device, an audio communications device such as an audio transceiver, and other features. The sensor unit 26 further includes one terminal of a sensor bidirectional local transceiver 36 that is in communication with the sensor unit processor 34 and that also receives the sensor output 32, either directly or through the sensor unit processor 34. The sensor unit processor 34 may also include a unidirectional or bidirectional audio capability with a microphone and/or a speaker, and in that case the sensor bidirectional local transceiver 36 supports voice communication as well as data communication.

The monitor unit 28 includes a monitor unit bidirectional local transceiver 38 that supports bidirectional wireless communication with the sensor bidirectional local transceiver 36, as indicated by the wireless communications link 40. The two bidirectional local transceivers 36 and 38 are preferably radio frequency transceivers of relatively low power. In a preferred case using currently available technology, the two bidirectional local transceivers 36 and 38 are Texas Instruments TRF 6900A transceivers operating in the ISM frequency band of from about 902 MHZ to about 928 MHZ and at a controllable power level of up to about 4 milliwatts. Such transceivers typically have a range of up to about 10 to 100 meters, and are therefore termed "local transceivers". Their range is limited by their available maximum power consumption, and their power is typically supplied by respective batteries (not shown) in the sensor unit 26 and the monitor unit 28.

In one conventional practice, the communication between the sensor unit 26 and the monitor unit 28 would be unidirectional in the direction from the sensor unit 26 to the monitor unit 28, keeping in mind that the sensor 30 performs only its sensing function and not a control function for some other piece of apparatus. In this conventional practice, there would be no reason to have communications from the monitor unit 28 back to the sensor unit 26. The present invention uses bidirectional communications with the sensor and provides important features and practices deriving from the bidirectional communications that optimize the operation of the monitoring system 20, and yield surprising and unexpected advantages relative to the conventional unidirectional communications approach. These approaches available through bidirectional communications will be discussed subsequently.

The monitor unit 28 further includes a monitor unit processor 42 in communication with the monitor unit bidirectional local transceiver 38. The monitor unit processor 42 typically includes a microprocessor. A monitor unit bidirectional remote transceiver 44 is in communication with the monitor unit processor 42.

The central unit 24 includes a central unit bidirectional remote transceiver 46 supporting bidirectional communications with the monitor unit bidirectional remote transceiver 44. The remote transceivers 44 and 46 may be of any operable type. In a preferred embodiment, the remote transceivers 44 and 46 are selectively linked by two (or more) different communications links. The remote transceivers 44 and 46 may be linked through the available cellular telephone system 48 to implement wireless communications on an urgent basis or in some cases for routine communications. In this communications arrangement, the monitor unit bidirectional remote transceiver 44 is typically linked to the cellular telephone system 48 via a dial-up wireless communications link 50, and the central unit bidirectional remote transceiver 46 is typically linked to the cellular telephone system 48 via a landline 52. (The link between the central unit bidirectional remote transceiver 46 and the cellular telephone system 48 may instead also be via a dial-up wireless communications link. An internet-based may also be used where available, with access to the internet being through a land line or with a wireless connection. The internet link may utilize any of the high-speed communications capabilities available in that medium.)

The second communications link between the remote transceivers 44 and 46 is a land-line 54 through the conventional hard-wired telephone system to implement routine communications. The monitor unit 28 is preferably structured to be connected with a base station 58 for communication through a connector 60. The base station 58 desirably includes a cradle in which the monitor unit 28 is received. The connector 60 is mated and electrically connected to the monitor unit 28 when the monitor unit 28 is placed into the cradle. The base station 58 includes a modem 62 that provides for bidirectional communication through the connector 60 with the monitor unit 28, and for land-line communication 54 to the central unit bidirectional remote transceiver 46. The base station 58 also includes a charging unit 64 and an appropriate connector that charges the rechargeable batteries of the monitor unit 28 when the monitor unit 28 is connected to the base station 58. The base station 58 may optionally be provided with an interface/communications link 65, such as an RS232 connector or a universal serial bus, to a separate optional computer 66 for local communications with the monitor unit 28. The computer 66, where present, may be linked by a separate communication path 67, such as a land line telephone line, to the central unit bidirectional remote transceiver 46.

In this architecture, the communications link through the base station 58 and land-line 54 is preferred for use when available. When there is no access to the conventional telephone system, however, the monitor unit 28 uses the communications link through the cellular telephone system 48. This cellular telephone capability allows the monitor unit 28 to be portable so that the patient has freedom of movement within the service area of the cellular telephone system. The present system is compatible with the use of other types of remote communications links, such as marine communications links, satellite communications links, and other communications technologies now available or that will be developed.

The central unit 24 further includes a central unit processor 56 in communication with the central unit bidirectional remote transceiver 46. The central unit processor 56 typically includes a microprocessor and interfaces with medical personnel and databases.

Further details of portions of the monitoring system 20 may be found in U.S. Pat. No. 5,959,529, whose entire disclosure is incorporated by reference.

FIGS. 2–6 are block diagrams illustrating examples of practices utilizing the bidirectional communication capability of the bidirectional local transceivers 36 and 38. Other practices may be employed as well in utilizing the bidirectional communication capability, and the use of the present invention is not limited to those discussed in relation to FIGS. 2–6.

Figure 2:
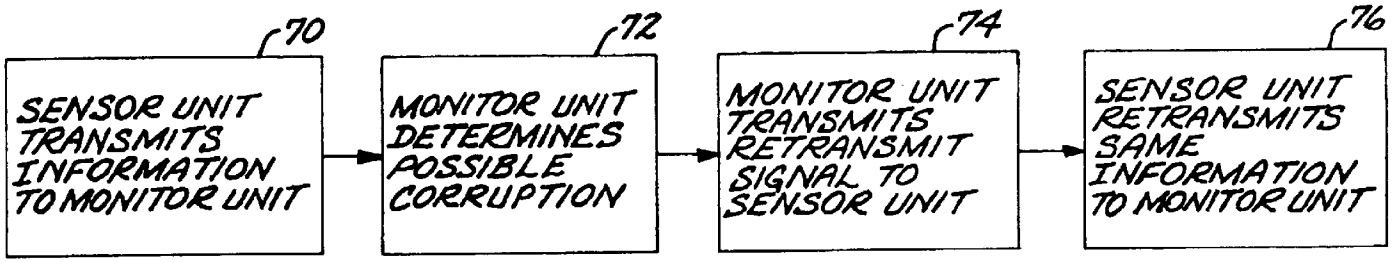
FIGS. 2–6 are block flow diagrams of methods for using the bidirectional communications capability between the sensor unit and the monitor unit of the monitoring system.

Referring to FIG. 2, the sensor unit 26 transmits information to the monitor unit 28, numeral 70, via the bidirectional local transceivers 36 and 38 over the communications link 40. This information is typically patient data from the sensor output 32, but it may be other information as well. Such information is normally transmitted in data packets. It is possible that the transmitted information is corrupted in some fashion, as by the loss of data bits. The monitor unit 28 determines whether the information is corrupted, numeral 72, using any suitable technique such as, for example, checksums, cyclic redundancy checks, or forward error correction and checking. The monitor unit 28 transmits a retransmit signal to the sensor unit 26, numeral 74, in the event that the information is corrupted as determined in step 72. In that event, the sensor unit 26 retransmits the same information to the monitor unit 28, numeral 76.

Figure 3:
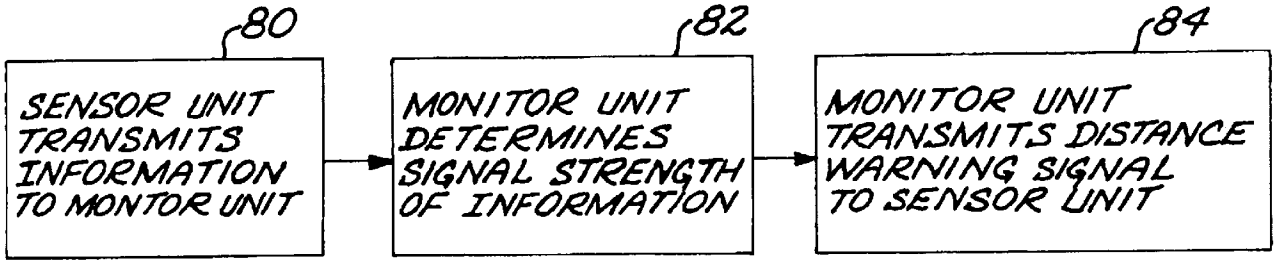

Referring to FIG. 3 showing another practice, the sensor unit 26 transmits information to the monitor unit 28, numeral 80. The monitor unit 28 determines a signal strength of the information, numeral 82. This determination is preferably made by evaluating the amplitude of a standard portion of the information that is provided for this purpose, either with an analog instrument or digitally. In the event that the signal strength is too low, suggesting that the physical distance between the sensor unit 26 and the monitor unit 28 is too far under the current transmission conditions, the monitor unit 28 transmits a distance warning signal to the sensor unit 26, numeral 84. The sensor unit 26 notifies the patient that the patient should not stray so far from the monitor unit 28 or should check the battery. Optionally, the monitor unit 28 may also inform the central unit 24 that the patient is exceeding the permissible distance between the sensor unit 26 and the monitor unit 28, so that the central unit 24 may separately contact the patient.

The approach of FIG. 3 may also be applied to determining whether the battery of the sensor unit 26 is discharging to such a low level that it may not support later transmissions. In this variation, the sensor unit transmits a battery voltage or other indication of the state of the battery charge in step 80. The transmitted information is evaluated, numeral 82. If the battery is discharged to an unsuitably low level, the patient is warned, numeral 84, so that the patient can change or recharge the battery.

Figure 4:
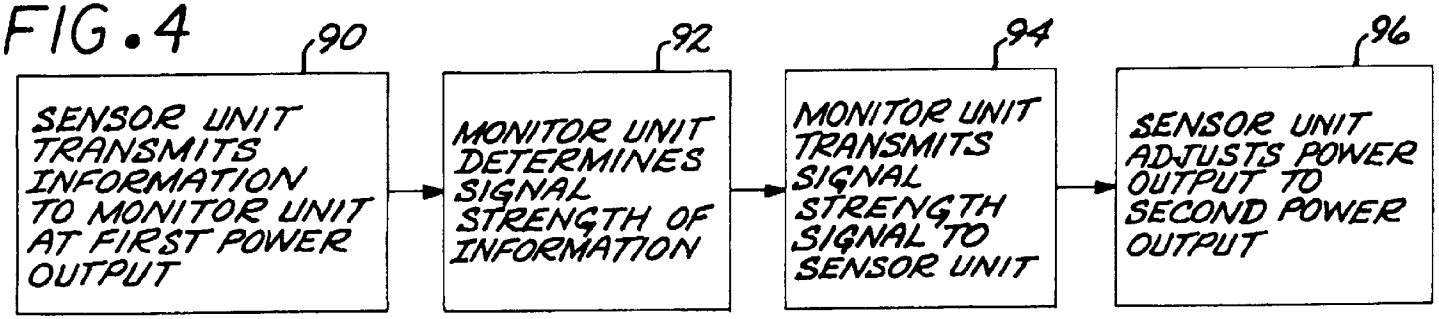

Even when the battery is not nearing discharge, it is desirable to adjust the operation of the sensor bidirectional local transceiver 36 so that it does not transmit at a higher power level than is necessary, in order to conserve the battery charge. Referring to FIG. 4 showing this practice, the sensor unit 26 transmits information to the monitor unit 28 at a first power output of the sensor bidirectional local transceiver 36, numeral 90. The monitor unit 28 determines a signal strength of the transmitted information, numeral 92, using the same approaches as discussed above in relation to step 82. The monitor unit 28 transmits a signal-strength signal to the sensor unit 26, numeral 94. The sensor unit 28 may thereafter adjust the power output of the sensor bidirectional local transceiver 36 to a second power output, numeral 96. (This practice may be performed in the opposite direction as well, wherein the monitor unit 28 transmits information to the sensor unit 26 at a first power output, the sensor unit 26 determines a signal strength of the information, the sensor unit 26 transmits a signal-strength signal to the monitor unit 28, and the monitor unit 28 adjusts the power output of the monitor unit bidirectional local transceiver 38.) The adjustment of the power output is important to conserving the battery power of the sensor unit 26 and the monitor unit 28. These units typically are small in size with relatively small battery capacity, and the adjustment of the power output helps to prolong the battery life. The adjustment of the power output may increase the power output when needed, or decrease the power output to the level where there is just sufficient signal strength to meet the requirements of the receiving unit.

Figure 5:
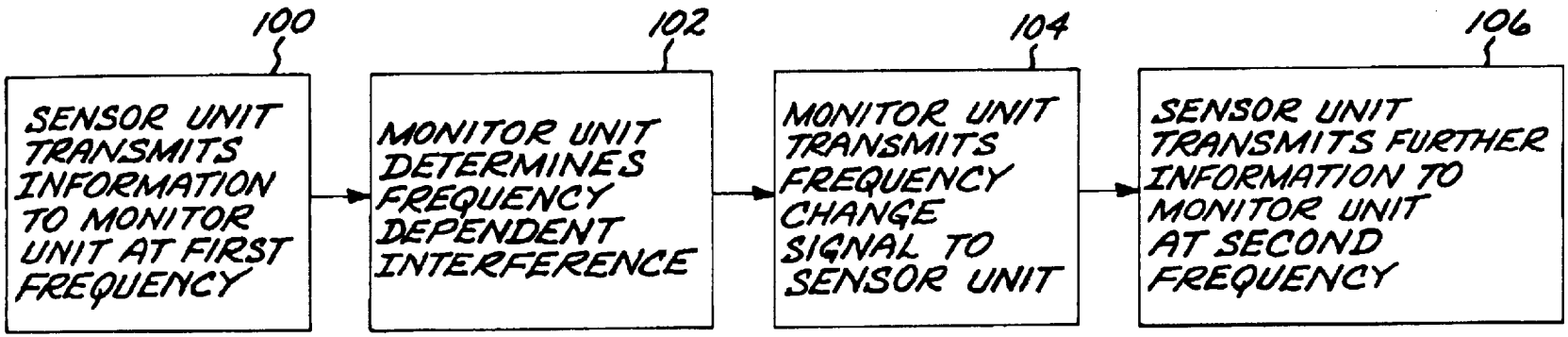

Referring to FIG. 5 showing another practice, the sensor unit 26 transmits information to the monitor unit 28 at a first frequency, numeral 100. The monitor unit 28 determines whether the transmitted signal is adversely affected by frequency-dependent interference, numeral 102. That is, most types of radio frequency interference are frequency-dependent, so that they affect transmissions at some frequencies and do not affect transmissions at other frequencies. The nature of the frequency-dependent interference may be determined in the monitor unit 28 by existing techniques such as noting corruption in data transmitted at different frequencies and by receiving data at unanticipated times. After the nature of the frequency-dependent interference and a potential clear frequency are determined, the monitor unit 28 transmits a frequency-change signal to the sensor unit 28, numeral 104. The sensor unit 26 then changes the frequency of transmission of the sensor bidirectional local transceiver 36, and the sensor unit 26 transmits further information to the monitor unit 28 at a second frequency, numeral 106. The further information can be a retransmission of the information which was interfered with at the first frequency, or subsequent information, or both. This process may be repeated if interference is observed and becomes troubling at the second frequency.

Figure 6:
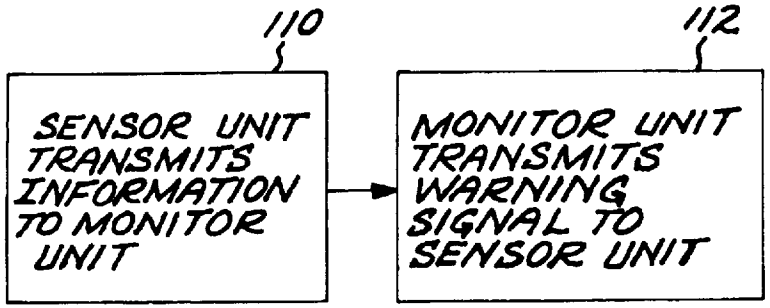

Referring to FIG. 6 showing another practice, the sensor unit 26 transmits information to the monitor unit 28, numeral 110. The monitor unit 28 transmits a warning signal to the sensor unit 26, numeral 112. The warning signal may be generated responsive to the information transmitted in step 110, or may be responsive to other sources. The warning signal may request the patient to come to the monitor unit, may request the patient to contact the central unit 24, or may request the patient to take one of many other possible actions such as replacing batteries in the sensor unit.

The various practices in FIGS. 2–6 are possible only because of the bidirectional communication capability between the local transceivers 36 and 38. These practices may be used individually, or in combination with each other or with other bidirectional capabilities.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A method for monitoring a patient, the method comprising:

providing a monitoring system comprising a remote monitoring unit comprising a sensor unit adapted to be carried on the body of a patient, the sensor unit comprising a sensor having a sensor output, a sensor bidirectional local transceiver that receives the sensor output, and a sensor unit processor in communication with the sensor unit bidirectional local transceiver, and a monitor unit, wherein the monitor unit is configured to be carried on the body of a person, the monitor unit comprising a monitor unit bidirectional local transceiver that supports bidirectional wireless communications with the sensor bidirectional local transceiver, a monitor unit processor in communication with the monitor unit bidirectional local transceiver, and a monitor unit bidirectional remote transceiver in communication with the monitor unit processor; and a base station having a cradle configured to interface with the monitor unit, the base station supporting bidirectional communications between the monitor unit and a central unit;

transmitting information bidirectionally between the sensor unit and the monitor unit.

2. The method of claim 1, wherein transmitting comprises the sensor unit transmitting information to the monitor unit, the monitor unit determining a signal strength of the information, and the monitor unit transmitting a distance warning signal to the sensor unit.

3. The method of claim 1, wherein transmitting comprises the sensor unit transmitting information to the monitor unit at a first power output, the monitor unit determining a signal strength of the information, and the monitor unit transmitting a signal-strength signal to the sensor unit.

4. The method of claim 3, further comprising the sensor unit adjusting the power output to a second power output.

5. The method of claim 1, wherein transmitting comprises the sensor unit transmitting information to the monitor unit at a first frequency, the monitor unit determining whether the signal is adversely affected by frequency-dependent interference, the monitor unit transmitting a frequency-change signal to the sensor unit in the event that the information is adversely affected by frequency-dependent interference.

6. The method of claim 5, further comprising the sensor unit transmitting further information to the monitor unit at a second frequency.

7. The method of claim 1, wherein transmitting comprises the sensor unit transmitting information to the monitor unit, and the monitor unit transmitting a warning signal to the sensor unit.

8. The method of claim 1, wherein providing a monitoring system further comprises providing the central unit comprising a central unit bidirectional remote transceiver supporting bidirectional communications with the monitor unit bidirectional remote transceiver, and a central unit processor in communication with the central unit bidirectional remote transceiver.

9. The method of claim 8, wherein the method for monitoring a patient further comprises transmitting information bidirectionally between the monitor unit and the central unit.

10. A monitoring system for monitoring a patient comprising:

a remote monitoring unit comprising:

a sensor unit comprising:

a sensor having a sensor output, a sensor bidirectional local transceiver that receives the sensor output, and a sensor unit processor in communication with the sensor unit bidirectional local transceiver;

a monitor unit, wherein the monitor unit is configured to be carried on the body of a person, the monitor unit comprising:

a monitor unit bidirectional local transceiver that supports bidirectional wireless communications with the sensor bidirectional local transceiver, a monitor unit processor in communication with the monitor unit bidirectional local transceiver, and a monitor unit bidirectional remote transceiver in communication with the monitor unit processor; and a base station having a cradle configured to interface with the monitor unit, the base station supporting bidirectional communications between the monitor unit and a central unit.

11. The monitoring system of claim 10, wherein the monitoring system further comprises the central unit comprising a central unit bidirectional remote transceiver supporting bidirectional communications with the monitor unit bidirectional remote transceiver, and a central unit processor in communication with the central unit bidirectional remote transceiver.

* * * * *